United States Patent [19]

Masaki

[11] Patent Number: 4,572,992

[45] Date of Patent: Feb. 25, 1986

[54] DEVICE FOR REGULATING AC CURRENT CIRCUIT

[75] Inventor: Kazumi Masaki, Osaka, Japan

[73] Assignee: Ken Hayashibara, Okayama, Japan

[21] Appl. No.: 616,165

[22] Filed: Jun. 1, 1984

[30] Foreign Application Priority Data

Jun. 16, 1983 [JP] Japan ..... 58-106848

[51] Int. Cl.[4] ..... G05F 1/00; H05B 37/02

[52] U.S. Cl. ..... 315/310; 315/127; 315/200 R; 315/205; 315/209 R; 323/238; 361/21

[58] Field of Search ..... 315/310, 127, 200 R, 315/205 R, 209 R; 361/21; 323/98, 238

[56] References Cited

U.S. PATENT DOCUMENTS

| | | | |
|---|---|---|---|
| 2,681,429 | 6/1954 | Long | 315/310 |
| 3,398,371 | 8/1968 | Lamb | 315/310 |
| 4,503,365 | 3/1985 | Kirk | 315/127 |

OTHER PUBLICATIONS

Low Voltage AC Hg Arc Lamp Power Supply by Davis et al., IBM Tech. Discl. Bull., vol. 18, No. 2, Jul. 1975.

*Primary Examiner*—Harold Dixon

*Attorney, Agent, or Firm*—Browdy and Neimark

[57] ABSTRACT

The present invention provides a device for regulating an ac current circuit using a magnetic relay which is suitable for use in an incandescent lamp circuit or electric motor circuit to eliminate or reduce inrush-current. The present device comprises connecting power switch, diodes, series resistance and relay such that, after closing the power switch, an ac current first flows to a load through the series resistance for a brief time, then to the load through the contacts of the relay after a lapse of the brief time by bypassing the series resistance.

11 Claims, 5 Drawing Figures

DEVICE FOR REGULATING AC CURRENT CIRCUIT

FIELD OF THE INVENTION

The present invention relates to a device for regulating an ac current circuit. More particularly, it relates to a device which is feasible for in the use of eliminating or reducing the occurrence of inrush-current in an ac current circuit, such as incandescent lamp circuit or electric motor circuit.

DETAILED DESCRIPTION OF THE INVENTION

In the regulation of an ac current circuit using its circuit current in an current circuit, the voltage fall between a current transformer or resistance inserted in the ac current circuit varies dependent upon the magnitude of the circuit current.

Based on the fact that the voltage fall between a diode, inserted in an ac current circuit, is approximately constant independent upon the circuit current when such diode is operated in the non-linear region of its voltage-current characteristic, i.e. for applied voltage from 0 to near 1 volt, the present invention is intended to utilize such voltage fall in the use of regulation or indication.

The device according to the invention will be explained hereinafter along with the Figures.

Figure 3:
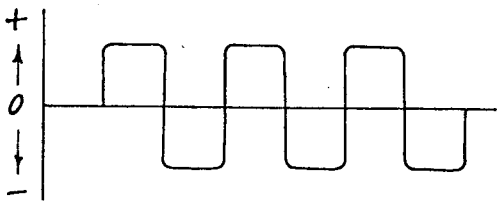

FIG. 3 indicates the waveform of the voltage fall generated between the pair of diodes which are operated in the nonlinear region of their voltage-current characteristic.

Figure 4:
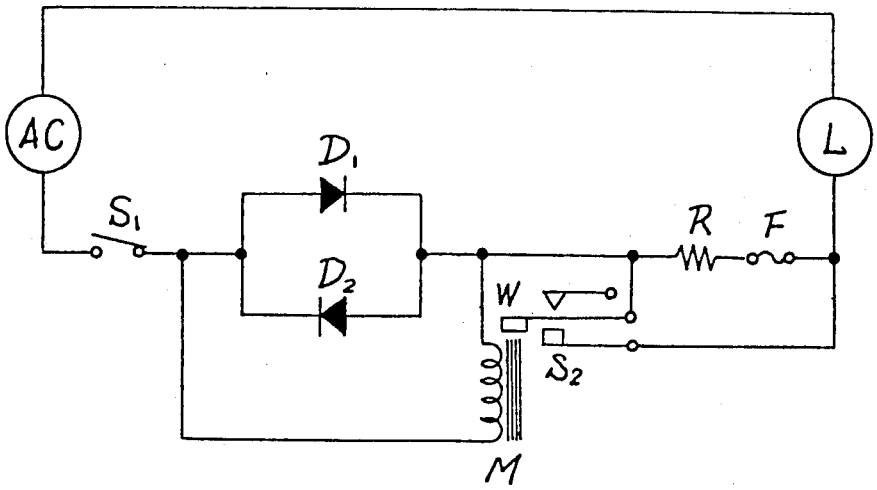

FIG. 4 illustrates an ac current circuit for eliminating inrush-current in an incandescent lamp circuit, wherein a pair of diodes are connected in reverse-parllel.

Figure 5:
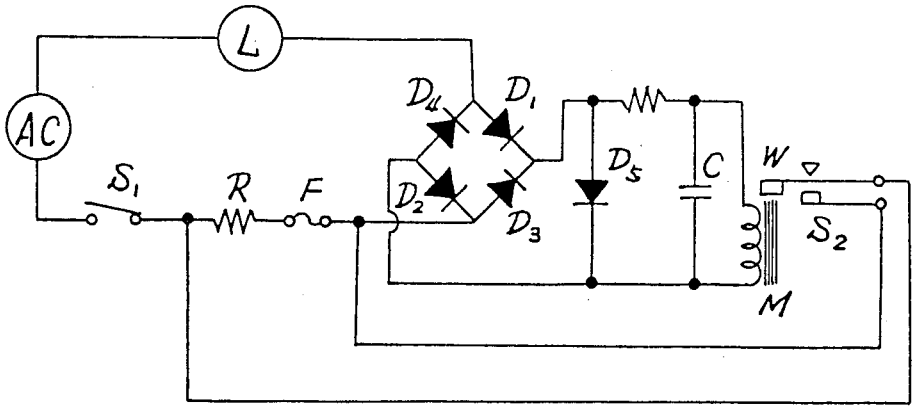

FIG. 5 shows another ac current circuit for eliminating inrush-current in an incandescent lamp circuit, wherein the output of a diode bridge is connected with another diode which is operated in the nonlinear region of its voltage-current characteristic.

In the Figures, AC means ac power souce; D, diode; F, thermosensitive fuse; S, switch; R, series resistance; and M, magnetic relay.

Figure 1:
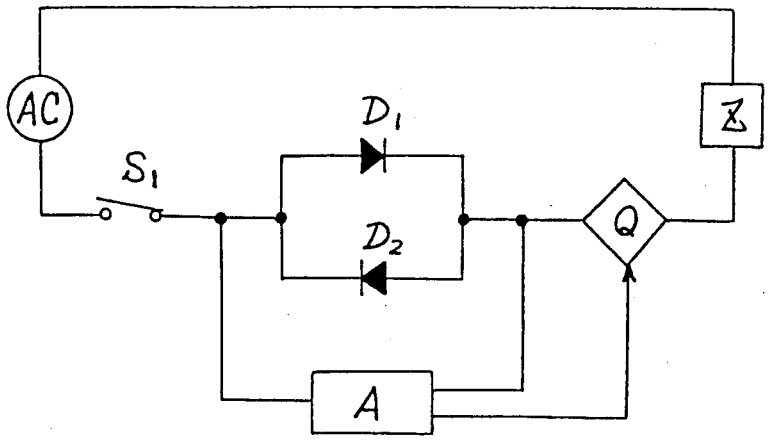
FIG. 1 shows a basic ac current circuit wherein a pair of diodes are connected in reverse-parallel.
Figure 2:
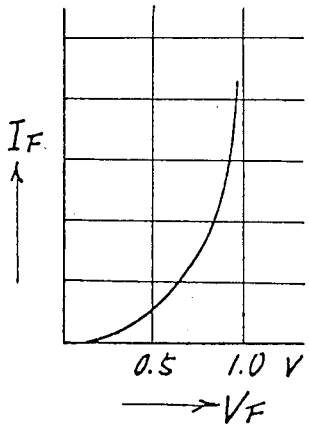
FIG. 2 shows a typical voltage-current characteristic of diodes which is applied with forward voltage.

In the ac current circuit given in FIG. 1, an ac current flows from an ac power source AC to load Z through power switch $S_1$ and the pair of diodes which are connected to reverse-parallel. According to the voltage-current curve as shown in FIG. 2, current $I_F$ begins to flow through a pair of diodes $D_1$ and $D_2$ when voltage $V_F$ increases certain level, and increases in a nonlinear sense for applied voltage. Current $I_F$ reaches a stationary state when voltage $V_F$ reaches approximately 1 volt. In many of diodes, the increment of current $I_F$ switches to a linear sense at a voltage $V_F$ in the range of 0.7–1.0 volt. When an ac current flows through the pair of diodes $D_1$ and $D_2$, a substantial voltage fall is found for applied voltage from 0 to 1 volt, whereas those at a voltage over 2 volts are negligible. Thus, a 0.7–0.8 volt square wave as shown in FIG. 3 generates between the pair of diodes.

In the ac circuit given in FIG. 4, a voltage between the pair of diodes $D_1$ and $D_2$, having a waveform as shown in FIG. 3, is allowed to flow to the coil of relay M to drive movable contact W and also to close switch $S_2$. This ac current circuit is an embodiment of the present invention, wherein closing of power switch $S_1$ permits an ac current to flow to incandescent lamp L through a pair of diodes $D_1$ and $D_2$, series resistance R and thermosensitive fuse F. For example, if series resistance R and the resistance of cold incandescent lamp L at room temperature are set to 90 and 10 ohms respectively, then the circuit current reaches 1 ampere when an ac 100 volts is applied thereto. This circuit current lights incandescent lamp L until the temperature of the incandescent increases. At the same time, the voltage fall between the pair of diodes, $D_1$ and $D_2$, is charged to magnetic relay M to operate contact W and also to close switch $S_2$. Thus, series resistance R and thermosensitive fuse F are both shorted, and incandescent lamp receives its rated voltage. Accordingly, the occurrence of a transitional inrush-current into cold filament can be avoided by the insertion of series resistance R. Insertion of thermosensitive fuse F is intended to open the circuit when the circuit is badly operated.

In the ac current circuit given in FIG. 5 using a diode bridge, an ac current flows from ac power source AC to incandescent lamp 1 through powe switch $S_1$, series resistance R, thermosensitive fuse F and diode bridge consisting of $D_1$, $D_2$, $D_3$ and $D_4$. In this circuit, another diode $D_5$ is connected with the output of the diode bridge so that diode $D_5$ can short the diode bridge. When diode $D_5$ is operated in the nonlinear region of its voltage-current characteristic, a substantial voltage fall between diode $D_5$ is supplied to magnetic relay M to close switch $S_2$, whereby series resistance R and thermosensitive fuse F are shorted and incandescent lamp L receives the rated voltage.

In the ac current circuit given in FIG. 4 or FIG. 5, since contact W of magnetic relay M should be operated a brief time after closing of power switch $S_1$, contact W is kept down with an appropriate weight to delay its closing at least 1/100 seconds after switching-on.

In the ac current circuit given in FIG. 1 or FIG. 4, the voltage fall between the pair of diodes, $D_1$ and $D_2$, was found to be 0.7–0.8 volts for applied current from 0.2 to 10 amperes. In the ac current circuit given in FIG. 5 using a diode bridge, the voltage fall between diode $D_5$ was found to be in the range of 0.7–0.8 volts for applied circuit current from 0.2 to 10 amperes. Accordingly, the use of a high-power diode attains an approximately constant voltage fall even when a circuit current of up to several hundred or several ten hundred amperes comes into flow.

As described hereinbefore, regulation or indication of various equipments is attainable by providing the voltage fall between a diode, operated in the non-linear region of its voltage-current characteristic, in the use of making a signal, sign or magnetic force, based on the diode property that such voltage fall is approximately constant independent upon the magnitude of applied circuit current. These regulation and indication are effectively usable, for example, in an incandescent lamp circuit or an electric motor circuit, to reduce or even eliminate the inrush-current and also to indicate the magnitude of the circuit current.

I claim:

1. A device for regulating an ac current circuit, said device comprising power switch, two or more diodes, series resistance and relay having a set of contacts and magnetic coil, wherein (a) said power switch, diodes, and series resistance being connected in series;

(b) the set of contacts of said relay being connected with said series resistance in parallel; and (c) the coil of said relay being connected with said diodes in parallel.

2. A device as set forth in claim 1, wherein said diodes are connected in reverse-parallel.

3. A device as set forth in claim 1, wherein the coil of said relay is connected with said diodes through a time constant circuit.

4. A device as set forth in claim 1, wherein the voltage fall between said diodes is in the range of 0.7–0.8 volts.

5. A device as set forth in claim 1, wherein said diodes are bridged.

6. A device for eliminating inrush-current in an incandescent lamp circuit, comprising power switch, two or more diodes, series resistance and relay having a set of contacts and magnetic coil, wherein (a) said power switch, diodes, and series resistance being connected with an incandescent lamp in series;

(b) the set of contacts of said relay being connected with said series resistance in parallel; and (c) the coil of said relay being connected with said diodes in parallel.

7. A device as set forth in claim 6, wherein said power switch, diodes, and series resistance are connected with an incandescent lamp in a manner that, after closing said power switch, an ac current first flows to the incandescent lamp through said series resistance for a period sufficient to warm-up its filament, then through the contacts of said relay after a lapse of the period.

8. A device as set forth in claim 7, wherein said period is set to at least 1/100 seconds.

9. A device for regulating an ac current circuit, said device comprising:

connecting a diode with an ac current circuit;

operating the diode in the non-linear region of its voltage-current characteristic to obtain a voltage fall between the diode; and driving a relay, indicator or contact with the voltage fall.

10. A device as set forth in claim 9, wherein a pair of diodes are connected with an ac current circuit in reverse-parallel in a manner such that the circuit current conducts in the forward or reverse sense.

11. A device as set forth in claim 9, wherein a diode bridge is connected with an ac current circuit, and that another diode is connected with the output of the diode bridge in the forward sense.

* * * * *